US011905774B2

(12) United States Patent
Martin

(10) Patent No.: US 11,905,774 B2
(45) Date of Patent: Feb. 20, 2024

(54) ANCHOR MECHANISM

(71) Applicant: VERTICE OIL TOOLS INC., Stafford, TX (US)

(72) Inventor: Shannon Martin, The Woodlands, TX (US)

(73) Assignee: VERTICE OIL TOOLS INC., Stafford, TX (US)

( * ) Notice: Subject to any disclaimer, the term of this patent is extended or adjusted under 35 U.S.C. 154(b) by 0 days.

(21) Appl. No.: 17/456,261

(22) Filed: Nov. 23, 2021

(65) Prior Publication Data

US 2023/0175330 A1 Jun. 8, 2023

(51) Int. Cl.
*E21B 23/01* (2006.01)
*E21B 33/129* (2006.01)

(52) U.S. Cl.
CPC ..... *E21B 23/01* (2013.01); *E21B 33/129* (2013.01); *E21B 33/1291* (2013.01)

(58) Field of Classification Search
CPC ..... E21B 23/00; E21B 23/01; E21B 33/129; E21B 33/1291; E21B 43/10
See application file for complete search history.

(56) References Cited

U.S. PATENT DOCUMENTS 3,241,616 A 3/1966 Cox
3,330,357 A 7/1967 Elliston
4,437,517 A * 3/1984 Bianchi ..... E21B 33/1295 166/212
4,576,230 A * 3/1986 Tapp ..... E21B 33/1292 166/138
4,659,119 A 4/1987 Reimert
4,697,947 A 10/1987 Bauer et al.
4,711,326 A * 12/1987 Baugh ..... E21B 23/01 166/212
4,762,177 A 8/1988 Smith, Jr.
5,174,397 A * 12/1992 Currington ..... E21B 23/01 166/138
5,487,427 A 1/1996 Curington
5,950,744 A 9/1999 Hughes
6,119,774 A * 9/2000 Doane ..... E21B 23/01 166/134

(Continued)

FOREIGN PATENT DOCUMENTS

DE 2310375 3/1973
GB 2276217 A 9/1994

(Continued)

OTHER PUBLICATIONS

Combined Search and Examination Report under Sections 17 & 18(3) from related Application No. GB1806818.9, dated Sep. 28, 2018. 6 Pages.

(Continued)

*Primary Examiner* — Yong-Suk (Philip) Ro
(74) *Attorney, Agent, or Firm* — Pierson IP, PLLC

(57) ABSTRACT

A downhole anchor mechanism for use in downhole tools. The downhole anchor mechanism generally consists of a plurality of sliders that pivot outwardly from a downhole tool body to engage distal ends thereof against a well casing. The sliders are operatively engaged within faceted cavities associated with the tool body, which creates load components that act in a tangential direction, allowing a thin-walled tool body to withstand increased holding force.

10 Claims, 14 Drawing Sheets

(56) References Cited

U.S. PATENT DOCUMENTS

| | | | | |
|---|---|---|---|---|
| 6,354,372 | B1 * | 3/2002 | Carisella | E21B 33/1216 166/134 |
| 6,722,428 | B2 * | 4/2004 | Yokley | E21B 43/10 166/216 |
| 7,318,000 | B2 | 1/2008 | Parvin et al. | |
| 9,845,645 | B2 | 12/2017 | Hughes et al. | |
| 10,060,197 | B2 | 8/2018 | Hughes et al. | |
| 10,066,446 | B2 | 9/2018 | Hughes et al. | |
| 11,098,542 | B2 * | 8/2021 | Provost | E21B 23/01 |
| 11,111,737 | B2 | 9/2021 | Radtke | |
| 2002/0174992 | A1 | 11/2002 | Dewey et al. | |
| 2004/0244966 | A1 * | 12/2004 | Zimmerman | E21B 33/1295 166/118 |
| 2008/0230218 | A1 | 9/2008 | Hall et al. | |
| 2015/0021048 | A1 | 1/2015 | Ruffo | |
| 2017/0174992 | A1 | 6/2017 | Ootsuki | |
| 2018/0313179 | A1 | 11/2018 | Kandaswami et al. | |
| 2021/0095530 | A1 | 4/2021 | Radtke | |
| 2021/0396080 | A1 | 12/2021 | Cockrill | |
| 2023/0072517 | A1 * | 3/2023 | Moreno | E21B 33/129 |

FOREIGN PATENT DOCUMENTS

| | | | |
|---|---|---|---|
| GB | 2573143 | A | 10/2019 |
| WO | 2021154907 | A1 | 8/2021 |
| WO | WO2021154907 | | 8/2021 |

OTHER PUBLICATIONS

Non-final Office Action from related U.S. Appl. No. 16/589,496, dated Oct. 21, 2020. 10 pages.
Final Office Action from related U.S. Appl. No. 16/589,496, dated Feb. 19, 2021. 7 pages.
Office Action from related GB2117802.5, dated May 25, 2022, 3 Pages.
Search report from related GB2117802.5, dated May 23, 2022, 2 Pages.
ISR & WO, dated Apr. 3, 2023.

* cited by examiner

Detail A

ANCHOR MECHANISM

This application is related to U.S. patent application Ser. No. 16/589,496, filed Oct. 1, 2019, now U.S. Pat. No. 11,111,737, issued Sep. 7, 2021, and U.S. patent application Ser. No. 17/466,530, filed Sep. 3, 2021, the entireties of which are incorporated by reference herein.

FIELD OF THE INVENTION

Embodiments of the present invention generally relate to a downhole anchor mechanism for a tubular assembly for use in oil and gas wells.

BACKGROUND OF THE INVENTION

Hydraulic fracturing, or fracking, is a technique for cracking rock by injecting a mixture of sand and fluid under pressure. This technique enables the extraction of oil or gas contained in highly compact and impermeable rocks.

The wellbores for fracking are drilled to a depth at which rock layers with hydrocarbon deposits are found. The wellbores are then drilled horizontally along the rock layer. Hydraulic fracturing of the horizontal wellbores is usually conducted in multiple stages, with fractures created in the surrounding rock at specific points along the wellbore.

Two methods of hydraulic fracturing are most commonly used. One of the most common techniques requires the well to have a cemented casing and involves a plug and perforate technique whereby cement plugs are created to isolate specific sections within the well; each section is then perforated and fractured. The plugs are then drilled, and the production stage of the operation is begun.

Another common technique uses a non-cemented casing arrangement where sliding sleeves and packers are provided around the outer circumference of the casing string. Once the casing string is inserted into the well, the packers are expanded to secure the string in position and isolate sections of the well to be fracked. The sleeves are then shifted to an open position by pumping specifically sized balls into the well. When a sleeve is actuated under the action of a ball, fracturing ports are opened, and the isolated zone is fractured and stimulated by fluid diverted through the open fracturing ports. The production stage of the operation can then begin.

After a few years in operation, the gas or oil production level of a well may decrease. Following the initial production period, it is common to stimulate the well by refracturing. Refracturing aims to either increase the original fractures' depth or develop a new network of fractures from which gas or oil may be extracted from the rock. Refracturing often restores well productivity to close to original levels and thus extends the lifespan of the well. Refracturing is performed in an existing wellbore and is, thus, advantageous because it does not require the steps of drilling and completing a wellbore. The process of refracturing an existing well is, therefore, often significantly less costly and more economical than drilling a new well.

In wells with a cemented casing, refracturing can be performed by installing and cementing a new casing having a smaller diameter than the original casing before a "plug and perforation" method of fracturing is used. It is important that the cement layer between the two casings provides a high-quality seal for the process to be effective. In addition, the perforating step conducted during the refracturing process must go through two casing walls. Alternatively, a new casing or tubular conduit provided with an expandable metallic tubular sleeve, or packer, may be provided where the sleeve is designed to expand within the original casing of the well with a plug and perforation technique subsequently employed again.

With each of these refracturing techniques, the newly provided casing has a reduced internal diameter compared to the initial internal diameter of the well casing. Generally, efforts are made to maximize the diameter of the new casing by reducing tolerances between the new casing and the existing casing to as small as possible. This creates a need for thin-walled packers to maintain the greatest inner diameter possible while still achieving sufficient gripping and sealing capability on the existing casing.

A limitation on such thin-walled arrangements is found in forming threaded couplings between the components. Such couplings are necessary to maintain a seal, provide sufficient tensile loading and meet torque ratings. Premium (sealing) threads are not available in the required sizes, and the wall is not thick enough to cut a normal ACME or Stub ACME thread. Additionally, these screw-threaded couplings do not handle radial loads well.

Gladstone, GB 2,267,217 discloses a connector with a dowel device for application in boring holes for mining or exploration. The device of Gladstone features grooves for interlocking sections, but the device is not applicable to refracturing. There is a rotary-drill casing connector with interconnecting male and female sleeves incorporating lugs and sockets around the periphery to transmit rotary motion and provide segmental abutment faces for supporting axial compressive loads. The two sleeves are held together using a flexible multi-stranded steel wire rope dowel inserted manually from the outside via an aperture into a circular annular cavity, half of which is formed on the inside face of the female sleeve and half-formed on the outer face of the male sleeve. The connection is sealed against leakage or ingress of fluids by a pliable sealing '0' ring contained in a groove formed in the sleeve such that the seal is compressed when the parts are connected.

Reimert, U.S. Pat. No. 4,659,119 discloses a connector assembly, including a pin connector for receipt by a box connector. An external surface of the pin features a helical groove, a generally complementary internal surface of the box features a helical groove of the same rotational sense and pitch. A helical latch coil is carried in one of the grooves, extending partly out of the groove. The connectors are latched together by stabbing the pin into the box so that the latch coil is ratcheted into place, partly extending into the groove of the connector not carrying the coil. Subsequent mutual rotation between the connectors in one rotational sense tightens the latched connection, and rotation in the opposite sense releases the latching. The connector functions without the need for substantial rotation or torque.

Bauer et al., U.S. Pat. No. 4,697,947 discloses a plug connection for drilling or boring tubes, rods, and worms for earth-boring equipment with a male part and a female part, with a radial coupling for torque transfer and with an axial coupling having in the overlap zone of the male and female parts, and a locking device that can be introduced into an annulus for transferring axial forces. The locking device is constructed as a multilink chain that essentially extends around the entire annulus and is introduced through the female part into the annulus via a single opening.

Lehmann, DE 2310375 discloses a detachable pipe end connection for locking opposing pipe ends with different joint designs and engageable gearing featuring a retractable overrunning pipe end rotatably fixed and centered, and both of an inserted flexible locking cord in one of two mutually opposite half-grooves in a cavity. The entire tube circumference outside the coupling region is blocked and secures and features a flexible locking cord. For insertion or removal of the flexible locking cord, window-like openings are provided.

It would be desirable to provide a coupling mechanism for securing tubular sections in a wellbore over a thin wall. It is also desirable to provide a anchor mechanism suited for use with thin-wall tubing that is configured to increase radial holding force onto a casing while not overstressing tool components.

SUMMARY OF THE INVENTION

It is one aspect of embodiments of the present invention to provide a downhole tool with a anchor mechanism comprising a plurality of slips positioned about and operatively engaged to a portion of the downhole tool's body (often referred to as a "mandrel"). The plurality of slips are configured to slide longitudinally along the mandrel (or portion thereof) and expand, which causes distal ends of the slips to engage an inner casing surface. The contemplated downhole tool may be a packer, liner hanger, or any other similar tool having a downhole coupling mechanism at its lower end configured to interconnect to a tubular string located deeper in a well.

The plurality of slips may be held in place against the mandrel by a wire and/or may be prevented from moving by a shear pin(s). These slip retaining devices maintain the plurality of slips adjacent to a conical portion of the mandrel while the downhole tool is lowered into the well, which is known to those of ordinary skill in the art as the "run in" configuration. The application of a longitudinal force onto proximal slider ends will break the wire and/or shear pin(s), thereby allowing the distal slider ends to expand outwardly.

The plurality of slips of the contemplated embodiments of the present invention can be forced against the casing surface to a great degree, which increases the anchor mechanism's holding capability. More specifically, stresses associated with slip loading are reacted by the walls of the mandrel in the tangential and radial directions as opposed to only in the radial direction. One of ordinary skill in the art will appreciate that this aspect allows for the often thin-walled mandrel to be loaded to a greater degree because the radial load component is decreased dramatically, which prevents mandrel compression load damage.

In some instances, a wall thickness of the downhole tool before actuating the slips is less than or equal to about 5%, 10%, 15%, or 20% of the outer diameter of the downhole tool before actuating the slips. A wall thickness of the downhole tool before actuating the slips may be less than or equal to about 8%, 10%, 12%, 14%, 16%, 18%, or 20% of the inner diameter of the downhole tool before actuating the slips. This aspect provides a thin-wall tubular connection. In some instances, the inner diameter at the coupling mechanism is greater than or equal to about 3.00", 3.20", 3.40", 3.50", 3.60", 3.70", 3.80", 3.90", 4.00", 4.10", 4.20", 4.40", or 4.60", and the outer diameter at the coupling mechanism is less than or equal to about 4.00", 4.10", 4.20", 4.40", 4.50", 4.60", 4.70" 4.80", 4.90", 5.00", 5.10", 5.20", or 5.40". In one embodiment, the inner diameter at the coupling mechanism is greater than or equal to about 3.8" (96.52 mm), and the outer diameter at the coupling mechanism is less than or equal to 4.7" (119.38 mm). The inner diameter provides the clearance through the bore of the downhole tool. The outer diameter determines the borehole size or installed casing/liner size through which the downhole tool can be run-in.

The downhole tool of one embodiment features a ratchet device that prevents movement of the slips from the expanded configuration. That is, the contemplated ratchet device provides a mechanism that maintains the plurality of slips in the radially extended position. The downhole tool also includes a piston lock to prevent movement of the piston until slip actuation.

The downhole tool may include a morphable element. The morphable element may be considered as a packer element. More preferably, the morphable element is a sleeve arranged on the tool body, sealed thereto and providing an annular chamber, that when fluid is introduced to the chamber, expands the sleeve to seal against a borehole wall or a tubular in which the packer element is located.

Thus, it is one aspect of one embodiment of the present invention to provide an anchor mechanism configured for use with a downhole tool, comprising: a member substantially having a cylindrical or frusto-conical outer profile, which defines a first volumetric envelope, and a plurality of longitudinally-disposed channels provided in the outer profile, the channels having an interiorly-disposed surface spaced from the outer profile that is bounded by angled walls extending from a distal end of the member and terminate before a proximal end of the member, thereby defining distal channel openings; and a plurality of slips, wherein each of the plurality of channels receives a corresponding slip, each slip having lateral surfaces configured to operatively engage onto the angled walls of the channel in which they are located, the slips further having: a first position of use wherein distal ends of the slips are located a first distance from the distal channel openings, wherein outermost surfaces associated with portions of the slips engaged within the channels do not extend beyond the volumetric envelope of the member; and a second position of use wherein distal ends of the slips are located a second distance from the distal channel openings, wherein the outermost surfaces associated with the portions of the slips engaged within the channels extend beyond the volumetric envelope of the member.

It is still yet another aspect of one embodiment to provide an anchor mechanism configured for use with a downhole tool, comprising: a member having an outer profile and a plurality of longitudinally-disposed channels provided in the outer profile; and a plurality of slips, wherein each of the plurality of channels receives a corresponding slip, the slips further having: a first position of use wherein distal ends of the slips are located a first distance from the distal channel openings; and a second position of use wherein distal ends of the slips are located a second distance from the distal channel openings, and wherein the distal ends of the slips extend away from the outer profile.

It is another aspect of one embodiment of the present invention to provide a downhole tool, comprising: a mandrel having a proximal end configured to be located towards an opening of a well; a cone positioned about the mandrel, the cone having an outer profile and a plurality of longitudinally-disposed channels provided in the outer profile; a plurality of slips positioned about the mandrel and operatively received by the plurality of channels; a spacer ring positioned about the mandrel and associated with distal ends of the slips; and a piston positioned about the mandrel and associated with the spacer ring.

The Summary of the Invention is neither intended nor should it be construed as being representative of the full extent and scope of the present invention. That is, these and other aspects and advantages will be apparent from the disclosure of the invention(s) described herein. Further, the above-described embodiments, aspects, objectives, and configurations are neither complete nor exhaustive. As will be appreciated, other embodiments of the invention are possible using, alone or in combination, one or more of the features set forth above or described below. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description and no limitation as to the scope of the present invention is intended by either the inclusion or non-inclusion of elements, components, etc. in this Summary of the Invention. Additional aspects of the present invention will become more readily apparent from the Detailed Description, particularly when taken together with the drawings.

The above-described benefits, embodiments, and/or characterizations are not necessarily complete or exhaustive, and in particular, as to the patentable subject matter disclosed herein. Other benefits, embodiments, and/or characterizations of the present invention are possible utilizing, alone or in combination, as set forth above and/or described in the accompanying figures and/or in the description herein below.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

Unless otherwise indicated, all numbers expressing quantities, dimensions, conditions, and so forth used in the specification and drawing figures are to be understood as being approximations which may be modified in all instances as required for a particular application of the novel assembly and method described herein.

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the Summary, Brief Description of the Drawings, Detailed Description and in the appended drawing figures.

BRIEF DESCRIPTION OF THE DRAWINGS

The accompanying drawings, which are incorporated in and constitute a part of the specification, illustrate embodiments of the invention and, together with the general description of the invention given above and the detailed description of the drawings given below, serve to explain the principles of these inventions.

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Figure 1:
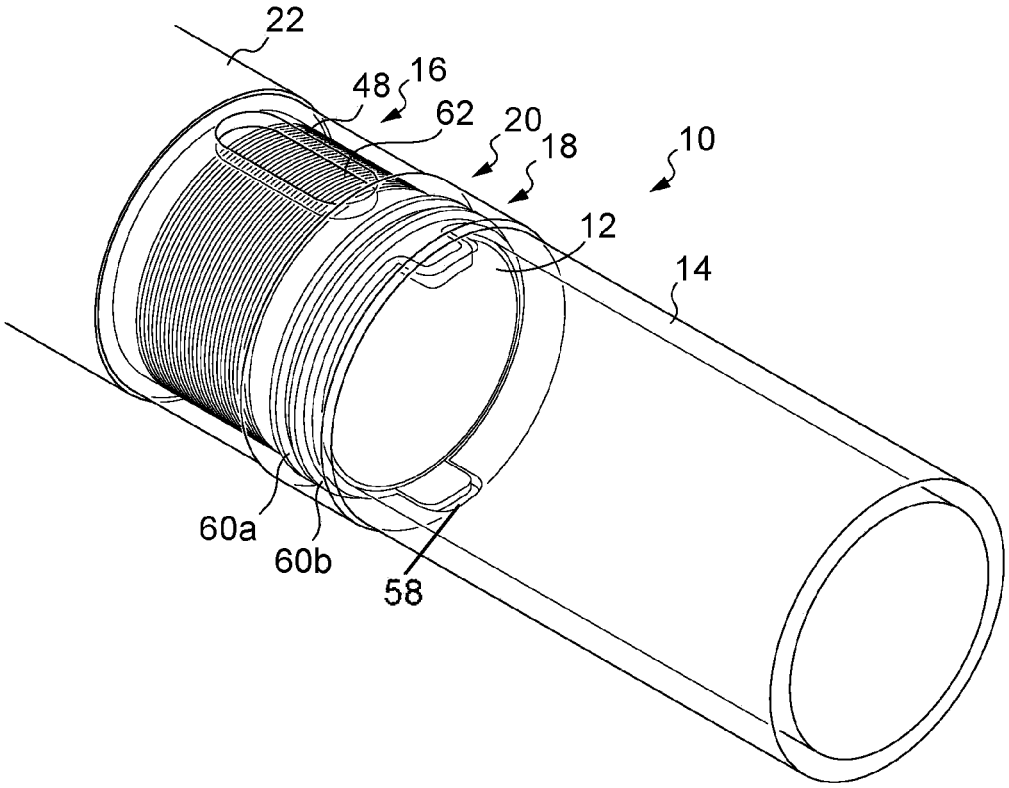
FIG. 1 is a partial perspective view of a downhole coupling mechanism as described herein.

Referring to FIG. 1, the drawings illustrate a downhole coupling mechanism 10 as described herein. The coupling mechanism 10 features a first tubular section 12 and a second tubular section 14 connected via a tensile load arrangement 16, a torque arrangement 18 and a seal arrangement 20. Arrangements 16, 18, 20 allow the tubular sections 12, 14 to be fixed together without a screw-threaded connection and can thus find application in small diameter bores and casing strings used downhole.

Figure 2A:
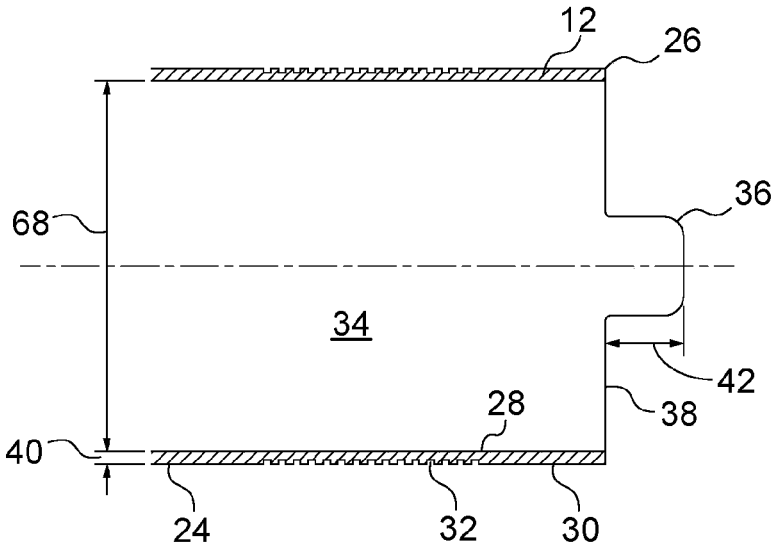
FIG. 2A is a cross-sectional view through a first tubular section of the downhole coupling mechanism of FIG. 1.

The first tubular section 12 is considered as an end piece to a downhole tool 22. The downhole tool 22 may be an packer, liner hanger, or similar tool used within a wellbore. FIG. 2A illustrates a tubular member 24 forming a portion of a downhole tool 22 and having a first tubular section 12 at a first end 26 thereof. Tubular section 12 has a smooth circumferential inner surface 28. The outer surface 30 is provided with a series of grooves 32. Each groove 32 may be square in cross-section though may be of any cross-sectional shape such as circular, v-grooved, dovetailed or a hooked profile. Each groove 32 is provided into the outer surface 30 to provide a continuous groove depth around a circumference of the outer surface 30. There are several grooves 32. In one embodiment, there are fifteen grooves, but there may be any number ranging typically from 3 to 20. The parallel grooves 32 are perpendicular to the bore 34 through the tool 22 and provide a continuous circumferential profile on the outer surface 30. The shape is entirely circumferential in that a cross-sectional view, as shown in FIG. 2A, would be identical for every cross-section around the tubular section 12. This is in contrast to a screw thread arrangement that would provide a single groove helically wound on the outer surface. A single wire may be fed around such a helical groove.

The first tubular section 12 also features lugs 36. Lugs 36 are protrusions or tongues extending from the end face 38 of section 12. These are best seen with the aid of FIG. 1. In one embodiment, two lugs 36 arranged equidistantly around the end face 38 are provided. However, there may be any number of lugs 36. Each lug 36 is may be square in cross-section with rounded edges to assist in assembly. Each lug 36 is of the same thickness as the wall thickness 40 of section 12 so that the inner 28 and outer surfaces 30 extend over the lugs. A protrusion length 42, coaxial with the bore 34, is also greater than the wall thickness 40.

Figure 2B:
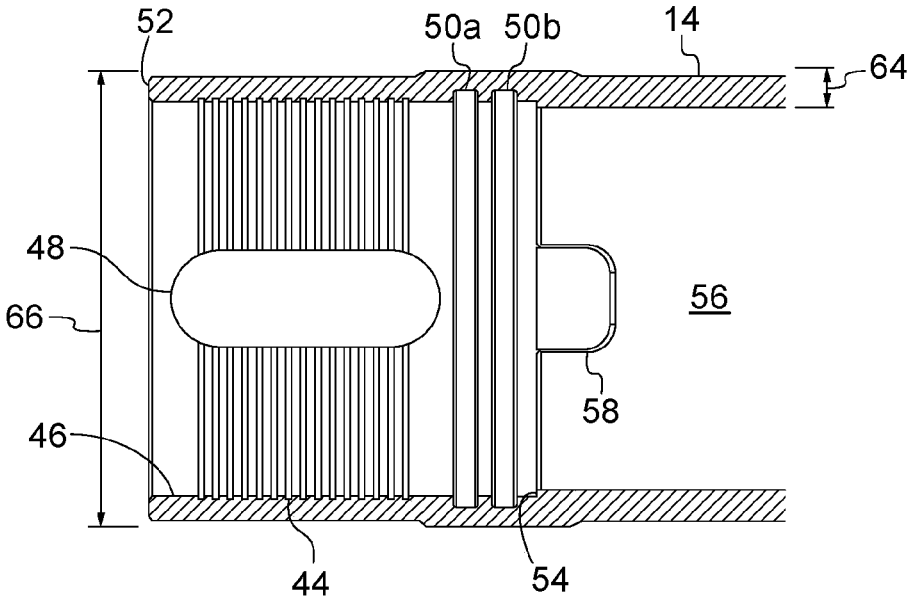
FIG. 2B is a cross-sectional view through a second tubular section of the downhole coupling mechanism of FIG. 1.

FIG. 2B illustrates the second tubular section 14 being the complementary mating section to the first tubular section 12. The second tubular section 14 also has a cylindrical body and a series of grooves 44. Grooves 44 match the grooves 32 in number, depth, and position along section 14 but are now arranged on the inner surface 46. A longitudinally arranged access window 48 is machined through section 14 over the grooves 44.

Adjacent to the grooves 44 are two further grooves 50*a*, 50*b*. The further grooves 50 *a*, 50 *b* are wider and deeper than the grooves 44, but they are also continuous around the inner surface 46 and are neither helical nor provide a thread. Though two further grooves 50*a*, 50*b* are shown, there may be a single further groove or more than two further grooves, but there will always be fewer further grooves 50 than grooves 44.

When considered from an end face 52 of the second tubular section 14, there are the grooves 44, the further grooves 50 and then a stop edge 54. Stop edge 54 is provided by a reduction in the inner diameter of the tubular section 14, providing a circumferential rim or lip arranged perpendicular to the bore 56. The stop edge 54 has a width greater than or equal to the wall thickness 40 of the first tubular section 12. Machined into the stop edge 54 is a notch 58 that does not extend through the wall thickness. There are two notches 58 that may be equidistantly machined around the edge 54; the number and dimensions of each notch 58 match the lugs 36 on the first tubular section 12. The second tubular section 14 may form part of tubing such as casing or liner. The second tubular section 14 may be considered as a bottom sub for connection to other downhole tools and components.

Returning to FIG. 1, the coupling mechanism 10 is illustrated in an assembled form. The second tubular section 14 has been slid over the first tubular section 12 until the end face 38 has abutted the stop edge 54. The sections 12 and 14 have been aligned so that the lugs 36 fit in the notches 58. Before engagement, seals 60 *a*, 60 *b* have been located in the further grooves 50 *a*, 50 *b*. Upon engagement, grooves 44 will be coaxial with grooves 32. Separate wires 62 are each located in one of the groove pairs 32,44 and joined to provide individual wire loops in each groove 44 via the access window 48.

The grooves 32,44 with corresponding wires 62 provide the tensile load arrangement 16. In one embodiment, there are fifteen grooves 32, 44 with corresponding wires 62. However, there may be more than three wires. There may be more than eleven wires. The increased number of wires increases the tensile loading of the coupling 10. The wires 62 may be of square cross-section and may be considered as a square locking wire. Wire having circular, triangular, rectangular, or other cross-sections may also be used. Each wire 62 has a diameter in cross-section, perpendicular to the axis of the bores 34, 56, greater than a depth of a groove 32, 44 into which they locate. This ensures that the wires 62 lie between the first and second tubular sections 12, 14. In the embodiment shown, the wires 62 are sized to fill both grooves 32,44 to prevent relative longitudinal movement of the tubular sections 12,14. This provides the required tensile loading through the coupling mechanism 10.

The seals 60*a*, 60*b*, within the further grooves 50*a*, 50*b*, that are sized to protrude from the further grooves 50*a*, 50*b* and be compressed against the outer surface 30 of the first tubular section 12 provides the seal arrangement 20. The seal arrangement 20 prevents the egress of fluid through the coupling mechanism 10.

The combination of the lugs 36 and notches 58 provide the torque arrangement 18. The length 42 of the lugs 36 provides abutting surfaces between the lugs 36 and notches 58 that are parallel with the axis of the bores 34, 56. As this length 42 is greater than a wall thickness 64 of the coupling mechanism 10, this gives a torque rating to the coupling mechanism 10 greater than the torque rating of a screw-threaded connection of similar thickness.

The tensile load arrangement 16, torque arrangement 18 and seal arrangement 20 of the coupling mechanism 10 can all be formed over relatively small wall thicknesses. The coupling mechanism 10 is suitable for slim hole arrangements where a maximum bore 34, 56 is required to be maintained. The wall thickness 64 of the made-up coupling mechanism 10 is less than or equal to 10% of the outer diameter 66 of the coupling mechanism 10. Also, the wall thickness 64 is less than or equal to 12% of the inner diameter 68 of the coupling mechanism 10. This provides a thin-wall tubular connection. In one embodiment, the inner diameter 68 is greater than or equal to 3.843" (97.61 mm) and the outer diameter 66 is less than or equal to 4.700" (118.44 mm). The inner diameter 68 provides clearance through the bore 34, 56 of the downhole tool 22.

By providing such a small relative wall thickness over the tubing diameter, the coupling mechanism 10 finds use on downhole tools used in refracturing operations such as anchors, liner hangers, and packers and provides particular advantages. An embodiment of a suitable anchor 70 with the coupling mechanism 10 is now described with reference to FIGS. 3A, 3B, 4A, and 4B.

Figure 3A:
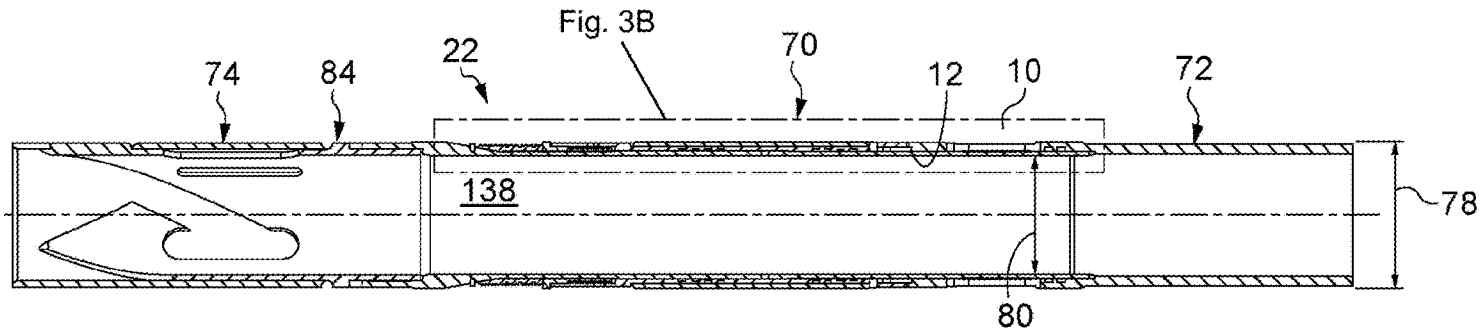
FIG. 3A is a cross-sectional view through an anchor including the downhole coupling mechanism of FIG. 1
Figure 3B:
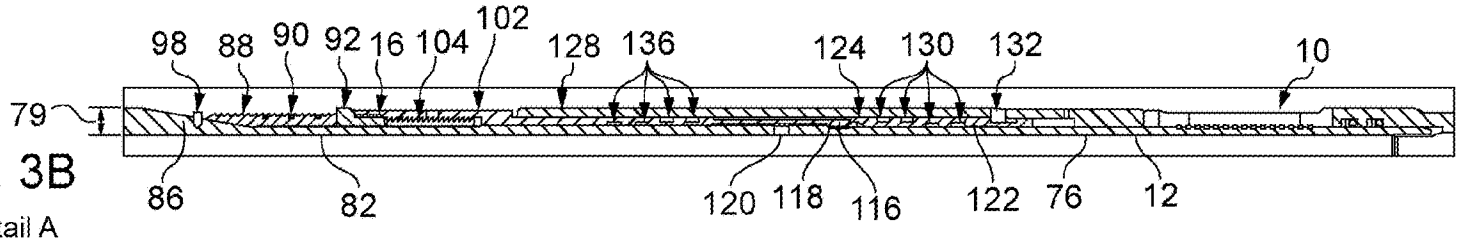
FIG. 3B is an exploded view of FIG. 3A.

FIG. 3A is a cross-section view of a downhole tool 22 being an anchor 70 incorporating the coupling mechanism 10 according to an embodiment described herein. The figure is provided in the standard downhole format with the right side being the lower end 72 of the tool 22 that is run into the wellbore first before the upper end 74 of the tool 22 shown on the left side of the figure. FIG. 3B is an exploded view of a section of the anchor 70 of FIG. 3A so that the features are clearer.

Anchor 70 features a substantially tubular body 76 with a maximum outer diameter 78 and minimum inner diameter 80. At the lower end 72 *a* coupling mechanism 10 is provided as described herein for connecting the anchor to another downhole component (not shown). The first tubular section 12 is part of an inner mandrel 82 that is connected at the upper end 74 to a J-housing 84 as is known in the art.

At the upper end 74 of the inner mandrel 82, the diameter is tapered to provide a downward-facing wedge 86 around the mandrel 82. Slips 88 are arranged around the mandrel 82 and initially held in place using a retaining wire 90 wrapped around the outside of the slips 88. Using a retaining ring 90 advantageously removes the requirement for mounts for the slips 88 that would increase the wall thickness 79 of the tool 22. The slips 88 abut a spacer ring 92 that can be moved upwards by action of a piston 102 so as to force the slips 88 up the wedge 86 moving them radially outwards to contact an inner surface 94 of the outer tubing 96. Movement of the slips is initially prevented by the location of a shear pin 98 in the wedge 86 at the front of the slips 88. This arrangement provides anchoring of the downhole tool 22 to the outer tubing 96.

Figure 4A:
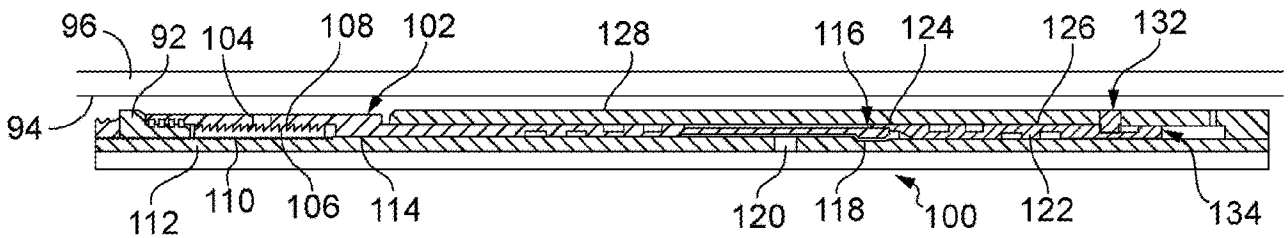
FIG. 4A is a cross-sectional view of the piston of the anchor of FIG. 3 shown in locked configuration.

A piston locking assembly 100 is used to prevent premature actuation of the anchor 70, especially during run-in. The piston locking assembly 100 sits between the spacer ring 92 and the coupling mechanism 10. FIG. 4A shows the piston locking assembly 100 in a run-in configuration.

Piston locking assembly 100 includes the piston 102 being a cylindrical body arranged around the mandrel 82. At the upper end, it is connected to the spacer ring 92 via a wire and groove arrangement as per the tensile load arrangement 16 described hereinbefore. Four wires are illustrated, but there could be any number. Behind the spacer ring 92 is a locking ring 104 whose outer surface 106 is threaded to attach to an inner surface 108 of the piston 102. The inner surface 110 of the locking ring 104 is also threaded with a complementary left-hand thread 112 along the outer surface 114 of the mandrel 82 that extends to the wedge 86. At a lower end of the piston 102 are collet fingers 116 directed inwardly and located in a recess 118 formed on the outer surface 114 of the mandrel 82. Recess 118 is located below a port 120 through the mandrel 82.

Below the piston 102 is a locking element 122. The ring has an upwardly directed lip 124 at its upper end, extending the outer surface 126 at the upper end. The locking element 122 also has a circumferential groove 134 around the outer surface 126 towards a lower end. A piston housing 128 slides over the locking element 122 and a portion of the piston 102. The piston housing 128 is fixed to the inner mandrel 82 and/or a second tubular portion 14 at the lower end. The locking element 122 is moveable between the housing 128 and mandrel 82 but is sealed 130 to both and initially held in place via a shear pins 132 through the housing 128 locating in the groove 134. Similarly, the piston 102 is moveable between the housing 128 and mandrel 82 but is sealed 136 to both and initially held in place by virtue of the collet fingers 116 located in the recess 118 and locked in place by the lip 124 of the locking element 122.

In the run-in configuration, shown in FIGS. 3A, 3B, and 4A, the slips 88 are held in position at the bottom of the wedge 86 by the retaining wire 90. The spacer ring 92 abuts the slips 88 and is held to the piston 102 with the locking ring 104 sitting adjacent the spacer ring 92 and connecting to the mandrel 82 and piston 102. The collet fingers 116 and in the recess 118. The locking element 122 is positioned so that the lip 124 is over ends of the collet fingers 116 and supports them in the recess 118. The locking element 122 is prevented from moving off the fingers 116 as it is held in place by shear pin 132 located through the housing 128 and locating in the groove 134. In this configuration, the tool 22 can be run in the outer tubing 96, and if it encounters ledges such as at casing collars, it cannot be activated.

Figure 4B:
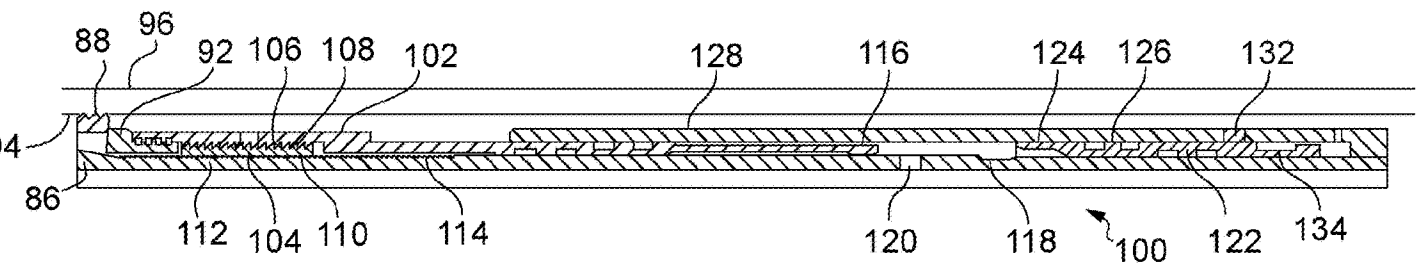
FIG. 4B is a cross-sectional view of the piston of the anchor of FIG. 3 shown in an unlocked configuration.

When the anchor 70 requires setting, pressure is applied through the bore 138 from the surface. The pressurized fluid enters the tool 22 through the port 120. The pressure acts on the locking element 122 until the pressure is sufficient to shear the pins 132 allowing the element to move downward until the lip 124 is clear of the collet fingers 116. This releases the collet fingers 116 so that they come out of the recess 118. Fluid pressure now acts on the piston 102 moving it upwards. The piston 102 acts on the locking ring 104, spacer ring 92 and ultimately the slips 88. With sufficient pressure the slips 88 move upwards along the wedge 86 and radially outwards so that they contact and grip the inner surface 94 of the outer tubing 96. On movement the slips 88 will contact and shear the shear pins 98 while breaking the retaining wire 90. Due to the close tolerance between the slips 88 and the outer tubing 96, the slips 88 will never clear the width of the spacer ring 92 and thus will only move upwards and outwards. The anchor set arrangement is illustrated in FIG. 4B. Advantageously, pressure does not have to be held to keep the anchor in the set configuration due to the locking ring 104 arrangement on the mandrel 82 that acts as a ratchet when the piston 102 moves.

The overall outer diameter 78 of the anchor 70 in the run-in configuration is less than or equal to the overall outer diameter 66 of the coupling mechanism 10. Thus, the anchor 70 is suitable for slim hole applications. Additionally, the minimum inner diameter 80 of the anchor 70 is equal to the minimum inner diameter 68 of coupling mechanism 10 by virtue of the inner tubular section 12 of the coupling mechanism 10 being formed on the same mandrel 82 as the anchor 70. Thus, the wall thickness 64, 79 of the anchor 70 and coupling mechanism 10 are substantially the same.

Figure 5:
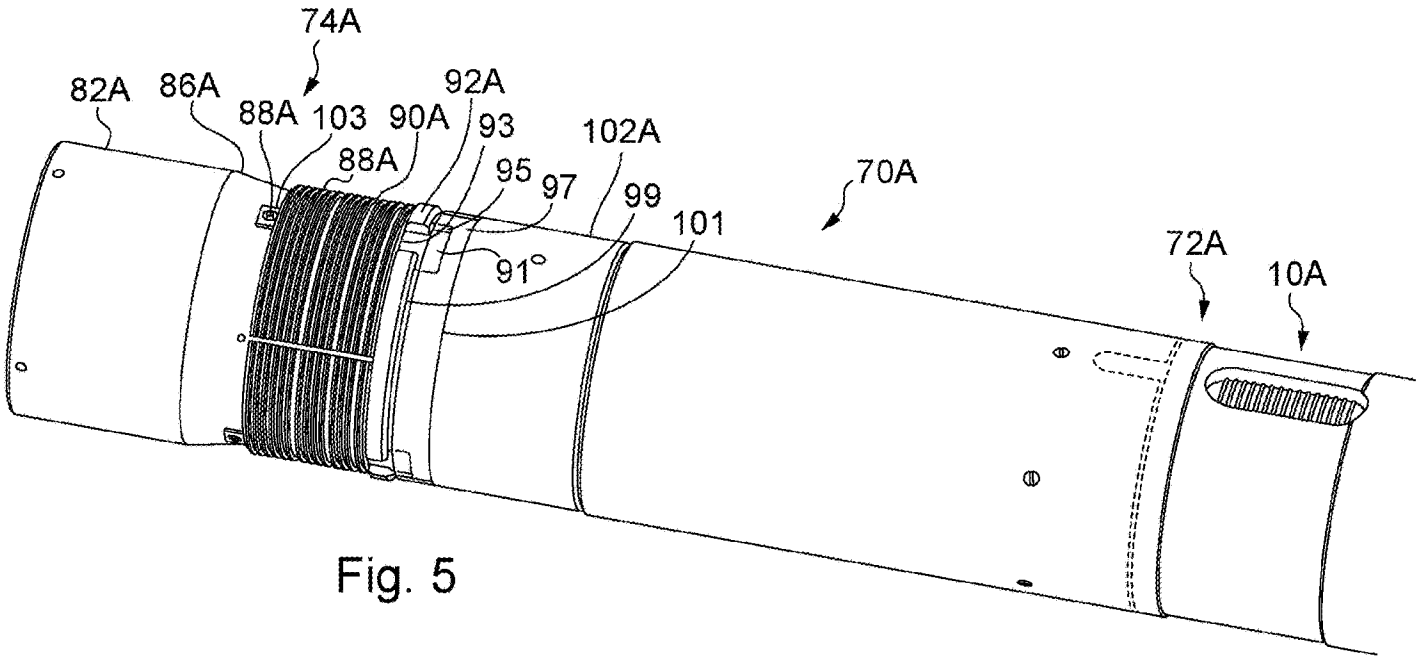
FIG. 5 is a perspective view of an alternate anchor, including the coupling mechanism of FIG. 1.

FIG. 5 illustrates an alternative embodiment for the slips 88A that provides a mechanical constraint to prevent the slips 88A from unwanted movement until actuation. Those like parts to FIGS. 3 and 4 are given the same reference numbers and suffixed 'A,' for clarity. FIG. 5 shows an anchor 70A where at the lower end 72A there is arranged a coupling mechanism 10A as described herein for connecting the anchor to another downhole component (not shown).

At the upper end 74A of the inner mandrel 82A, the diameter is tapered to provide a downward facing wedge 86A around the mandrel 82A. Slips 88A are arranged around the mandrel 82A and initially held in place using three retaining wires 90A wrapped around the outside of the slips 88A in the same manner as for FIGS. 3 and 4. However, where the slips 88 abutted a spacer ring 92 in the earlier embodiment, the slips 88A now have tabs 91 extending from a lower end 93. Typically, there is a tab 91 on each section of the slip 88A. Spacer ring 92A is extended to provide mating recesses 95 for the tabs 91. The spacer ring 92A is connected to the piston 102A in an identical manner as before with the addition of a securing band 97, between a lower shoulder 99 of the spacer ring 92A and the end face 101 of the piston 102. The securing band 97 (shown in transparency in FIG. 6) of soft metal lies over the interlocking arrangement of tabs 91 and recesses to prevent movement radially outwards when the piston 102 is actuated. Further, the shear pin 88 on the wedge 86 is now a pin or screw 88A, located in a front tab 103 of each slip 88A. This secures the front or nose of the slips 88A to the mandrel 82A to provide added security to the slips and prevent unwanted movement until actuation is desired. Anchor 70A is operated in the same manner as anchor 70.

Figure 6:
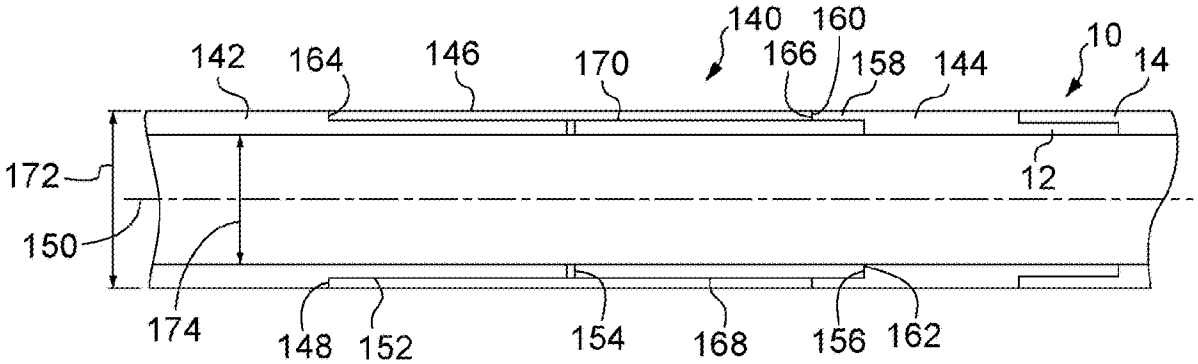
FIG. 6 is a cross-sectional view through a packer suitable for use with the downhole coupling mechanism of FIG. 1.
Figure 7:
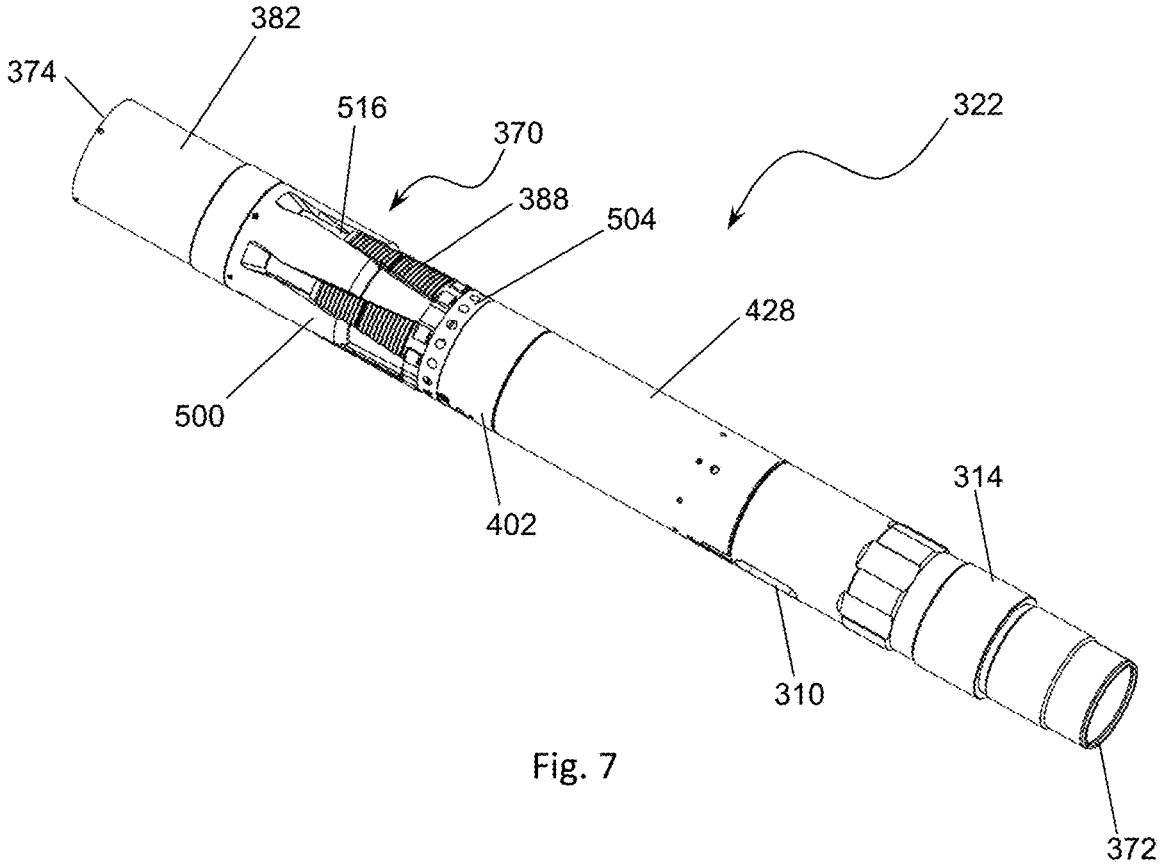
FIG. 7 is a perspective view of a downhole tool that employs an alternate anchor mechanism.
Figure 8:
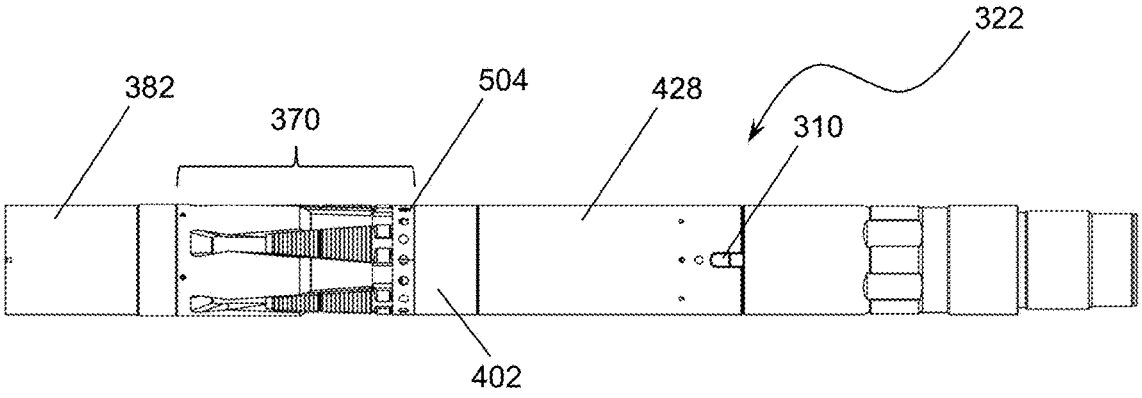
FIG. 8 is an elevation view of FIG. 7.

A further embodiment of a downhole tool 22 that can use the coupling mechanism 10 is a packer 140, as illustrated in FIG. 6. Packer 140 features three tubular parts, a mandrel 142, a bottom section 144, and a sleeve member 146. Each part is machined as a single piece, and the bottom section 144 forms the first tubular section 12 of the coupling mechanism 10. The mandrel 142 provides a downward facing ledge 148 perpendicular to an axis of the central bore 150 on its outer surface 152. There is a port 154 through the mandrel 142. The mandrel 142 has an end face 156 at its lower end that is perpendicular to the axis of the central bore 150. The bottom section 144 is arranged at the lower end of the mandrel with a portion 158 extending over the mandrel 142 and presenting an upward facing end face 160 that is perpendicular to the axis of the central bore 150. The bottom section 144 has an upward facing ledge 162 that is perpendicular to the axis of the central bore 150. The lower end of the bottom section 144 forms the first tubular section 12 of the coupling mechanism 10. A tubular section with first and second end faces 164, 166 respectively forms the sleeve member 146.

The sleeve member 146 is slid over the mandrel 142 in order to abut the ledge 148 with the first end face 164. The ledge 148 and face 164 are joined together. The bottom section 144 is then slid over the end of the mandrel 142 so the portion 158 sits on the mandrel and the end face 160 abuts the second end face 166 of the sleeve member 146. The faces are joined together. This connection also sees the ledge 162 of the bottom section 144 abutting the end face 156 of the mandrel 142. The ledge 162 and face 156 are joined together. The mandrel 142 and bottom section 144 are made of a hardened steel that does not yield under pressure. The sleeve member 146 is made of a ductile metal that yields under pressure. The joints are formed by welding or other suitable techniques known to those skilled in the art to provide a pressure tight seal between the components.

The packer 140 is run into the well in the configuration shown in FIG. 6. At the desired location, fluid pressure is increased from the surface, or via a running tool inside the packer 140, so that fluid under pressure enters the port 154. This fluid reaches a chamber 168 created between the outer surface 152 of the mandrel 142 and the inner surface 170 of the sleeve member 146. The ductile metal of the sleeve member 146 yields and expands. The sleeve member 146 morphs against the inner surface 94 of the outer tubing 96 and creates a metal to metal seal. As the sleeve member 146 undergoes elastic and plastic deformation during morphing, the packer 140 holds a seal between the packer 140 and the outer tubing 96 thereby maintaining a seal across the annulus between both.

The overall outer diameter 172 of the packer 140 in the run-in configuration is less than or equal to the overall outer diameter 66 of the coupling mechanism 10. Thus, the packer 140 is suitable for slim hole applications. Additionally, the minimum inner diameter 174 of the packer 140 is equal to the minimum inner diameter 68 of the coupling mechanism 10 by virtue of the inner tubular section 12 of the coupling mechanism 10 being formed in the same piece as the bottom section 144. Thus, the wall thickness 64, 176 of packer 140 and coupling mechanism 10 are substantially the same.

The anchor 70 may be used along with the packer 140 on a string. Advantageously the anchor 70 may be located above the packer 140 as the anchor 70 does not require holding pressure in use. This is the reverse of typical packers where the slips are used to expand the packer element and thus pressure must be held by the anchor to keep the packer element expanded in use.

FIGS. 7, 8, and 12-14 show a downhole tool 322 of another embodiment of the present invention that employs an alternative anchor mechanism 370. The downhole tool 322 generally consists of a mandrel 382 interconnected to a cone 500 that selectively receives a plurality of slips 388. The slips are associated with a piston 402, which is also operatively interconnected to a housing 428. FIGS. 7, 8, and 12-14 are provided in the standard downhole format, with the right side being a lower end 372 of the tool 322 that is run into the wellbore before an upper end 374 of the tool 322.

The downhole tool 322 has a maximum outer diameter and minimum inner diameter. The lower end 372 is configured to selectively accept another downhole component (not shown) using a coupling mechanism 310. The contemplated coupling mechanism may be that shown in FIGS. 1-2B, wherein a first tubular section 12 is part of the mandrel 382, as is known in the art.

Figure 9:
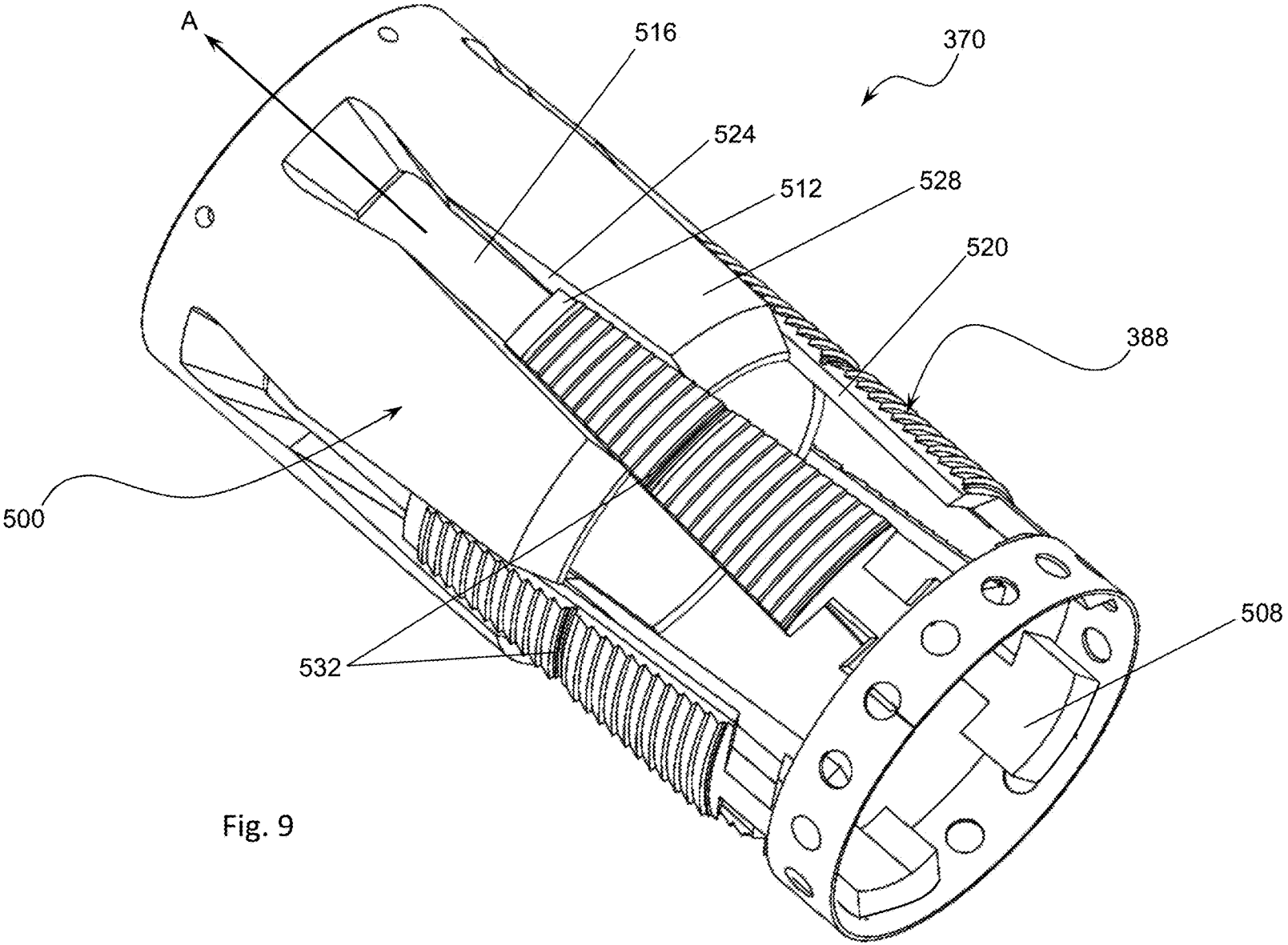
FIG. 9 is a perspective view of an anchor mechanism of one embodiment of the present invention, wherein components have been removed for clarity.
Figure 10:
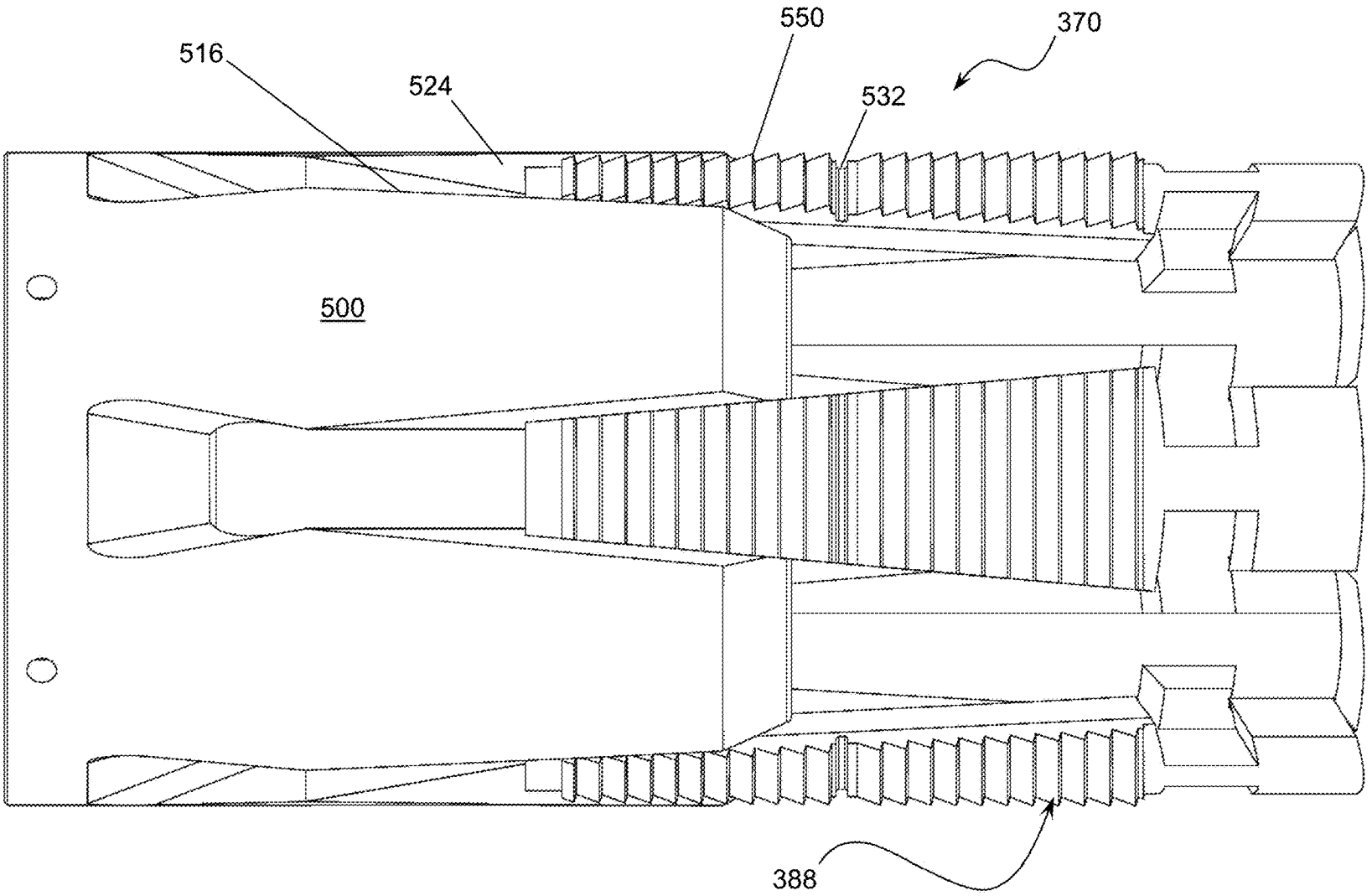
FIG. 10 is a front elevation view of FIG. 9.
Figure 11:
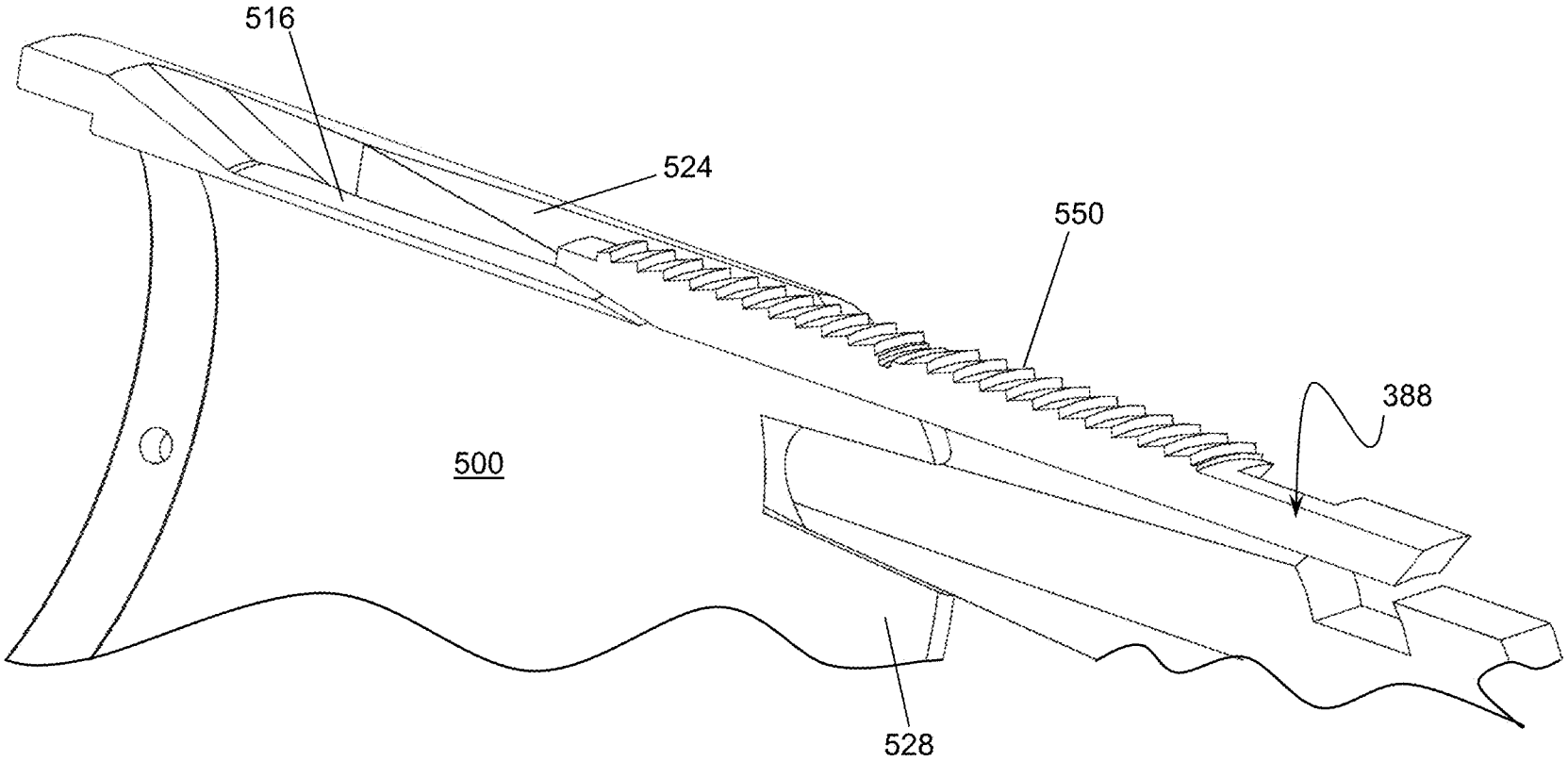
FIG. 11 is a partial cross-sectional view showing the anchor mechanism of FIG. 9.

FIGS. 9-11 show the anchor mechanism 370 employed by this embodiment of the present invention that comprises a cone 500 configured to interconnect to the mandrel and a plurality of operatively interconnected slips 388. The slips 388 are arranged around the cone 500 and may be initially held in place using a retaining wire positioned in a groove 532 provided in the slips 388. The retaining wire removes the requirement for slip mounts that would increase the tool's wall thickness. The slips 388 are secured to the tool body by a slip retainer ring 504 that maintains the slip proximal ends 508 against the mandrel. Movement of the slips may also be initially prevented by a shear pin(s) located in webbing 516 of the cone 500 that abuts the distal slip ends 512.

The slips 388 abut a spacer ring (FIG. 13, 392) that is moved by a piston 402 to force the slips 388 further onto the cone 500. The cone 500 includes a plurality of longitudinal channels configured to receive corresponding slips. The channels have interior surfaces that define the webbing 516 and angled or faceted lateral surfaces 524 that function somewhat like the wedge described above. The channels of one embodiment of the present invention are tapered and wider at the distal end of the cone 500. The slips 388 may be likewise tapered, wherein the proximal ends thereof are wider than the distal ends. In operation, as the slips move in the direction of Arrow A, which will be described in further detail below, the slip distal ends 512 will engage lateral surfaces 520, which urge the slips outwardly, generally along the path of Arrow B (see FIG. 14). Movement of the slips 388 within channels engages slip lateral surfaces 520 onto corresponding channel walls 524. As will be more apparent upon review of FIGS. 15 and 16, the channels also define fingers 528 that maintain the slip's 388 angular orientation relative to the cone's outer diameter.

Figure 12:
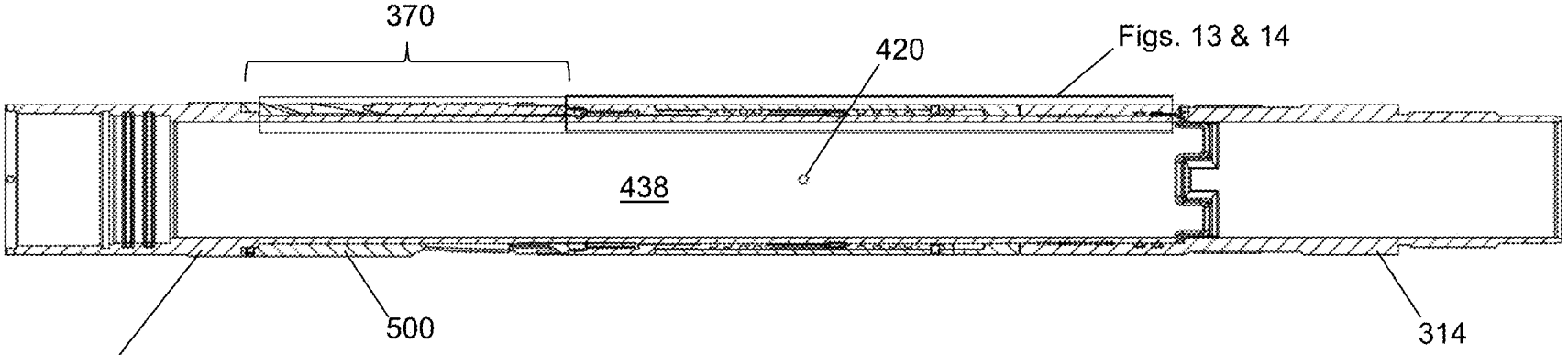
FIG. 12 is a cross-sectional view of FIG. 7.
Figure 13:
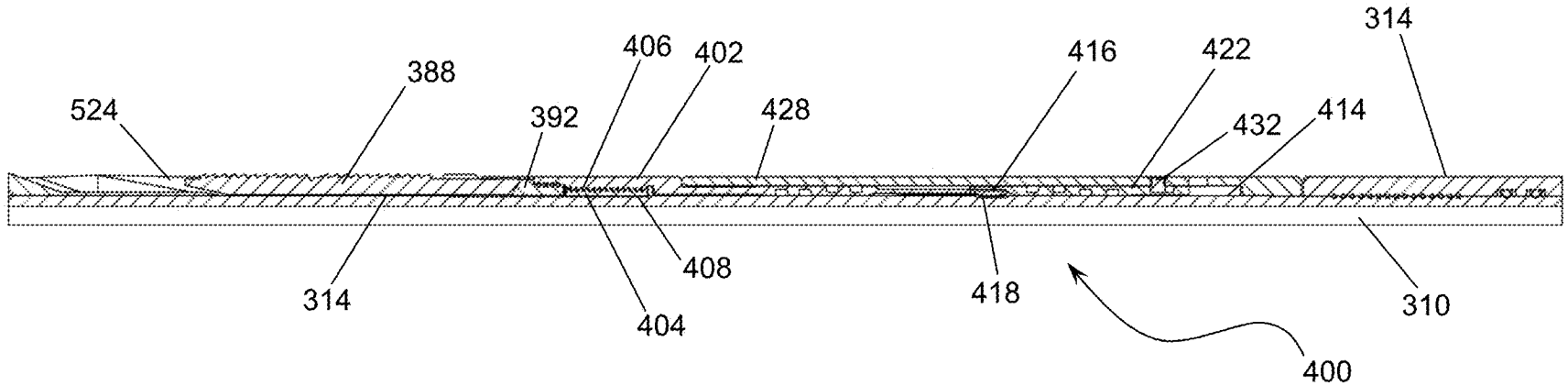
FIG. 13 is a detailed view of FIG. 12, showing the downhole tool in a run-in position of use.
Figure 14:
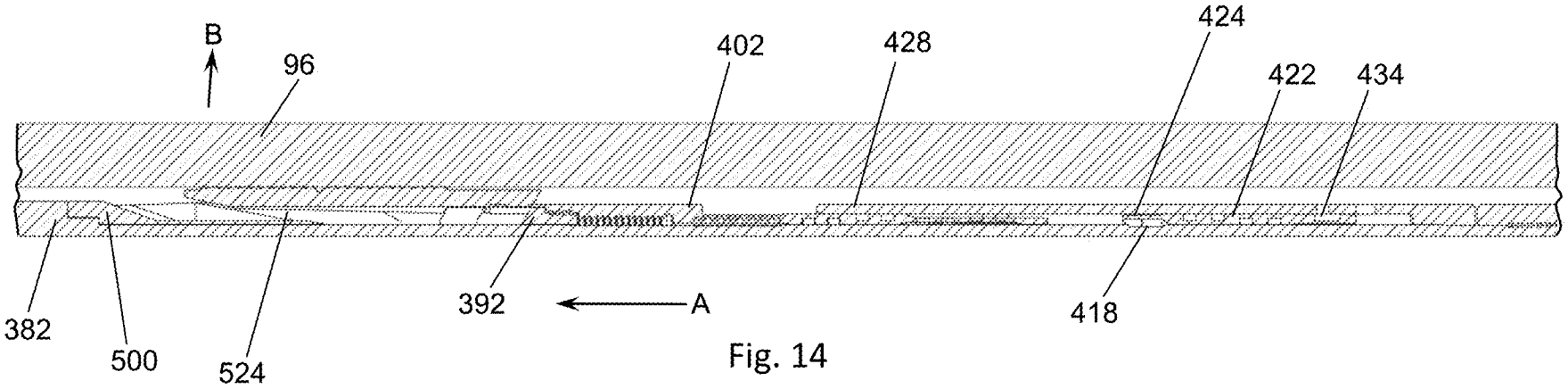
FIG. 14 is a detailed view of FIG. 14, showing the downhole tool in a set position of use.

FIGS. 12-14 illustrate the operation of the anchor mechanism 370 of one embodiment of the present invention that employs a piston locking assembly 400 to prevent premature actuation of the anchor 370 during run-in. The piston locking assembly 400 is located between the spacer ring 392 and the coupling mechanism 310. FIGS. 12 and 13 show the piston locking assembly 400 in a run-in configuration. The piston 402 is a cylindrical body arranged around the mandrel 382 and is connected at its upper end to the spacer ring 392 via a wire and groove arrangement, which may be similar to the configuration described above. A locking ring 404 is positioned behind the spacer ring 392. The locking ring 404 has an outer threaded surface 406 that attaches to an inner surface 408 of the piston 402. Collet fingers 416 are located at a lower end of the piston 402. The collet fingers are directed inwardly and locate in a recess 418 formed on the outer surface 414 of the mandrel 382. The recess 418 is located below a port through the mandrel 382 (see FIG. 12, reference numeral 420).

A piston lock 422 is positioned below the piston 402 and generally comprises a ring with a lip 424 at its upper end. The piston lock 422 also has a circumferential groove 434 around the outer surface adjacent to its lower end. A piston housing 428 slides over the locking element 422 and a portion of the piston 402. The piston housing 428 is fixed to the mandrel 382 and/or a second tubular portion 314 at the lower end. The locking element 422 is moveable between the housing 428 and mandrel 382 but is sealed to both and initially held in place via a shear pins/screws 432 through the housing 428 located in the groove 434. Similarly, the piston 402 is moveable between the housing 428 and mandrel 382 but is sealed to both and initially held in place by the collet fingers 416 located in the recess 418 and locked in place by the lip 424 of the locking element 422.

In the run-in configuration, shown in FIGS. 12 and 13, the slips 388 are held in position at the bottom of the cone 500 by the retaining wire. The spacer ring 392 abuts the proximal end of the slips 388 and is held to the piston 402 with the locking ring 404 positioned adjacent the spacer ring 392 and connecting to the mandrel 382 and piston 402. The collet fingers 416 are shown in the recess 418, and the locking element 422 is positioned so that the lip 424 is located over the ends of the collet fingers 416 to maintain the collet fingers in the recess 418. The locking element 422 is prevented from moving from the fingers 416 as it is held in place by the shear pin 432 located through the housing 428 and located in the groove 434. In this configuration, the tool 322 can be run into the casing 96, and if it encounters ledges such as at casing collars, it cannot be activated.

The anchor mechanism set arrangement is illustrated in FIG. 14. Pressurized fluid enters the tool 322 through the bore 438 which exits the port 420 to "set" the anchor mechanism 370. The pressurized fluid acts on the locking element 422 until the pressure is sufficient to shear the pins 432, allowing the locking element 422 to move downward until the lip 424 clears the collet fingers 416, which allows the collet fingers 416 to expand out of the recess 418. Fluid pressure then acts on the piston 402, moving it upwards to act on the locking ring 404, spacer ring 392, and ultimately the slips 388. The slips 388 will move upwards along the cone 500 and radially outwards until they contact and grip the inner surface of the casing 96, wherein teeth 550 of the slips dig into the casing. Urging the slips in this matter will also abut the slip distal ends against corresponding shear pins to sever the same and break any retaining wires provided. Close tolerance between the slips 388 and the casing 96 prevents the slips 388 from clearing the outer diameter of the spacer ring 392 and, thus, movement of the slips in the direction opposite Arrow A is impossible. In one embodiment, pressure does not have to be held to keep the anchor mechanism in the set configuration due to the locking ring 404 arrangement on the mandrel 382 that acts as a ratchet preventing the piston from traveling in a direction opposite Arrow A.

The overall outer diameter of the downhole tool in the run-in configuration is less than or equal to the overall outer diameter of the coupling mechanism. Thus, the anchor mechanism 370 is suitable for slim hole applications. Additionally, in some embodiments, the minimum inner diameter of the anchor mechanism 370 is equal to the minimum inner diameter of the coupling mechanism by virtue of the inner tubular section of the coupling mechanism being formed on the same mandrel 382 as the anchor mechanism 370. Thus, the wall thickness of the anchor mechanism and the coupling mechanism may be substantially the same.

Figure 15:
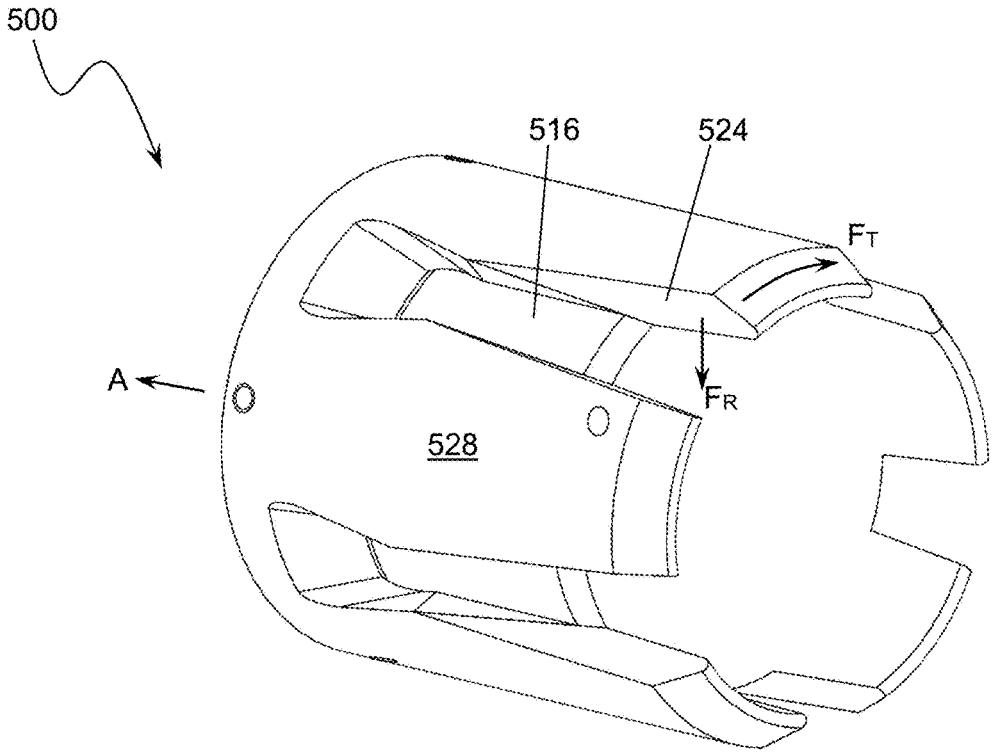
FIG. 15 is a perspective view showing a cone of the anchor mechanism of FIG. 9.
Figure 16:
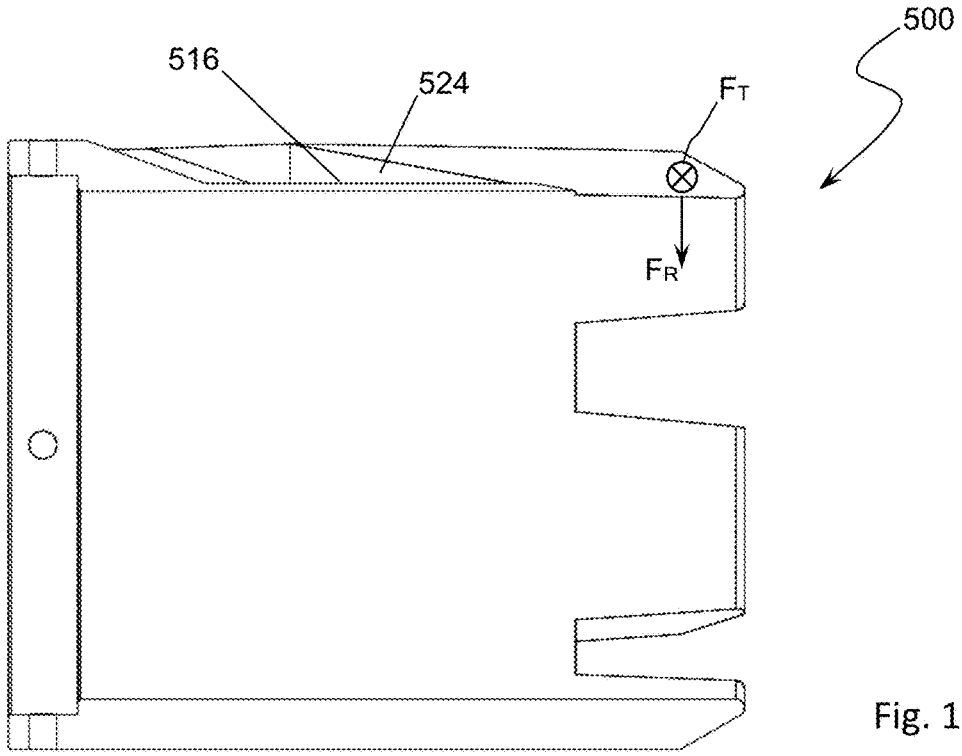
FIG. 16 a front cross-sectional view of FIG. 15.

FIGS. 15 and 16 show the cone 500 of one embodiment of the present invention. As described above, the cone 500 is generally comprised of a series of circumferentially situated fingers 528 that define channels therebetween. The channels are further defined by a bottom surface that comprises the aforementioned webbing 516 bounded by angled or faceted lateral walls 524. In operation, the lateral walls 524 are loaded in the tangential direction when engaged by corresponding slip lateral surfaces 520 as the slips move in the direction of Arrow A. The tangential loads, which is denoted as F T, generally compress the fingers 528. As in the embodiments described above, the slips will eventually engage the casing, wherein a reactive radial load will be directed into the outer surfaces of the slips which will transfer to zones where the slip lateral surfaces 520 and the channel walls 524 engage. Because the engagement surfaces are angled relative to the radial direction, the reactive load will be split into a X-Y components, depicted in the drawings as F R and F T. One of ordinary skill in the art will appreciate F R is akin to a reduced radial load and F T is a tangential load directed into the thickness of the fingers and compresses the same. One of ordinary skill in the art will appreciate that this configuration, thus, creates force components in directions other than radially into the mandrel end, i.e. the cone, as in the embodiments described above. Accordingly, the cone 500 can receive much more slip loading, which translates into a more secure grasp of the tool onto the casing.

It will also be appreciated from a review of FIGS. 15 and 16 that a fluid flow path associated with the outer surface of the fingers will be provided when the slips are engaged onto the casing wall, which may be beneficial.

Figure 17:
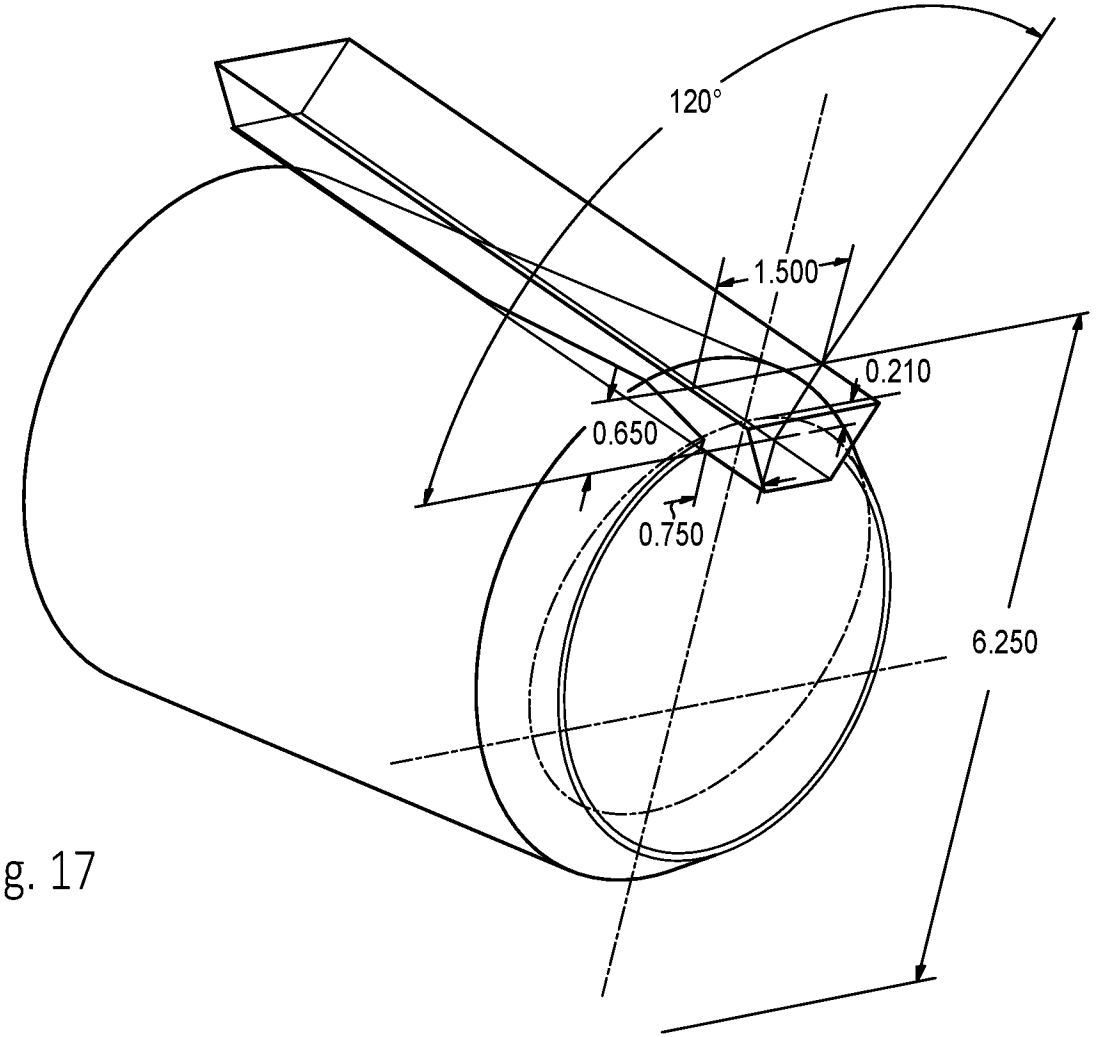
FIG. 17 is a perspective view showing a cone of FIG. 15 as a material blank.
Figure 18:
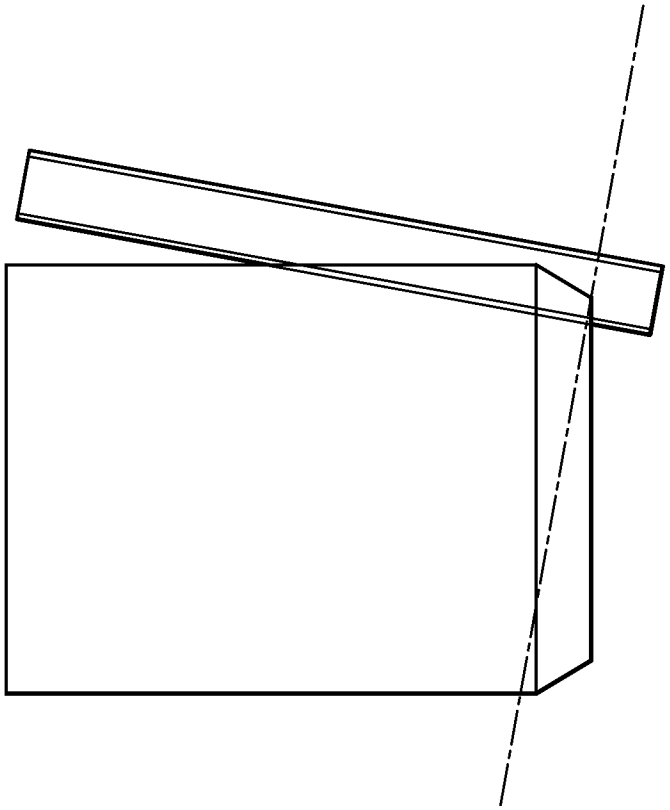
FIG. 18 is a side elevation view of FIG. 17.
Figure 19:
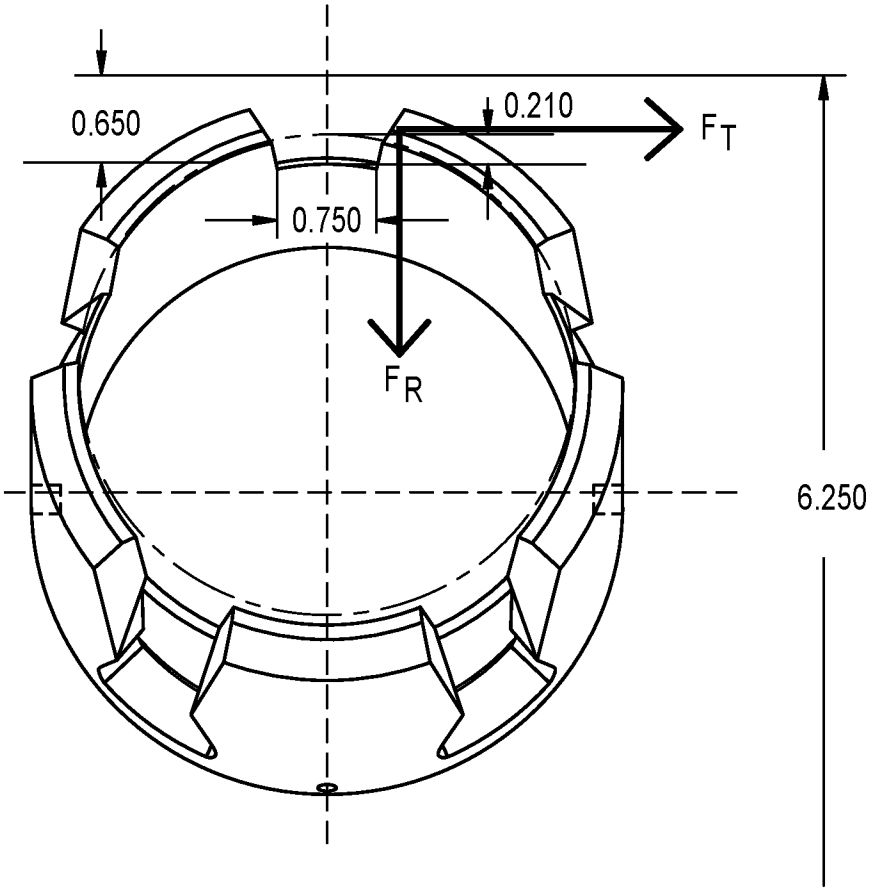
FIG. 19 is a right elevation view of FIG. 17, wherein the blank has been modified to define a plurality of fingers with channels therebetween.

FIG. 17-19 illustrate the construction of an cone 500 of one embodiment of the present invention; those of ordinary skill in the art will appreciate that the dimensions shown are for reference only and only illustrate the dimensions used in one embodiment of the present invention. Indeed, the magnitudes of F R and F T are directly proportional to the channel wall angle, which will, thus, dictate the cone wall thickness needed to withstand a given load.

Exemplary characteristics of embodiments of the present invention have been described. However, to avoid unnecessarily obscuring embodiments of the present invention, the preceding description may omit several known apparatus, methods, systems, structures, and/or devices one of ordinary skill in the art would understand are commonly included with the embodiments of the present invention. Such omissions are not to be construed as a limitation of the scope of the claimed invention. Specific details are set forth to provide an understanding of some embodiments of the present invention. It should, however, be appreciated that embodiments of the present invention may be practiced in a variety of ways beyond the specific detail set forth herein.

Modifications and alterations of the various embodiments of the present invention described herein will occur to those skilled in the art. It is to be expressly understood that such modifications and alterations are within the scope and spirit of the present invention, as set forth in the following claims. Further, it is to be understood that the invention(s) described herein is not limited in its application to the details of construction and the arrangement of components set forth in the preceding description or illustrated in the drawings. That is, the embodiments of the invention described herein are capable of being practiced or of being carried out in various ways. The scope of the various embodiments described herein is indicated by the following claims rather than by the foregoing description. And all changes which come within the meaning and range of equivalency of the claims are to be embraced within their scope. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

The foregoing disclosure is not intended to limit the invention to the form or forms disclosed herein. In the foregoing Detailed Description, for example, various features of the invention are grouped together in one or more embodiments for the purpose of streamlining the disclosure. This method of disclosure is not to be interpreted as reflecting an intention that the claimed inventions require more features than expressly recited. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention. Further, the embodiments of the present invention described herein include components, methods, processes, systems, and/or apparatus substantially as depicted and described herein, including various sub-combinations and subsets thereof. Accordingly, one of skill in the art will appreciate that would be possible to provide for some features of the embodiments of the present invention without providing others. Stated differently, any one or more of the aspects, features, elements, means, or embodiments as disclosed herein may be combined with any one or more other aspects, features, elements, means, or embodiments as disclosed herein.

What is claimed is:

1. An anchor mechanism configured for use with a downhole tool, comprising:

a member with a plurality of fingers;

a channel positioned between the plurality of fingers, the channel including a first portion and a second portion, wherein a minimum width across the channel between the first portion and the second portion is narrower than a distal end of the channel across the second portion of the channel and a proximal end of the channel across the first portion of the channel, the second portion included angled walls extending to the minimum width;

a slip configured to move along the angled walls of the second portion of the channel from the distal end of the channel toward the first portion of the channel, wherein a fluid flow path is created between the first portion of the channel and an inner surface of a first end of the slip after the first end of the slip moves radially outward and axially along the angled walls of the second portion of the channel, wherein when the first end of the slip moves along the angled walls of the second portion of the channel the first end of the slip is positioned radially outside the first portion of the channel.

2. The anchoring mechanism of claim 1, wherein the first portion includes first tapered walls that decrease a width across the first portion of the channel from the proximal end of the channel to the minimum width.

3. The anchoring mechanism of claim 2, wherein the angled walls of the second portion increase a width across the second portion of the channel from the distal end of the channel to the minimum width.

4. The anchor mechanism of claim 1, further comprising:

a retaining device configured to secure the slip against the member before the slip moves along the angled walls of the second portion of the channel.

5. The anchor mechanism of claim 4, further comprising:

webbing extending across the channel, wherein the retaining device is a shear pin projecting away from the webbing, the shear pin being configured to restrict the movement of the slip, wherein the shear pin is configured to shear responsive to the slip moving along the angled walls of the second portion of the channel.

6. The anchor mechanism of claim 1, further comprising:

a wire configured to secure the slip against the member before the slip moves along the angled walls of the second portion, wherein an inner surface of the first end of the slip is tapered to decrease a thickness of the first end of the slip, the body of the slip extending from the first end of the slip to a second end of the slip, the body of the slip having a substantially constant inner diameter.

7. The anchor mechanism of claim 1, further comprising:

a coupling mechanism coupled to the member, the coupling mechanism including a first tubular section having first circumferential grooves, the first circumferential grooves being positioned on an outer surface of the first tubular section, and a second tubular section having second circumferential grooves, the second circumferential grooves being positioned on an outer surface of the second tubular section, wherein the second tubular section being configured to be slid over the first tubular section to co-axially align the first circumferential grooves and the second circumferential grooves.

8. The anchor mechanism of claim 7, further comprising:

at least one wire located with the first circumferential grooves and a complimentary one of the second circumferential grooves, wherein each pair of the first circumferential grooves and the second circumferential grooves include the at least one wire extending around a circumference of the coupling mechanism.

9. The anchor mechanism of claim 8, further comprising:

a window extending through the first member, wherein the at least one wire is joined through the window.

10. The anchor mechanism of claim 1, wherein the fluid flow path is provided when the slip is engaged onto a casing wall.

* * * * *